United States Patent [19]

Nakamura et al.

[11] 4,102,772

[45] Jul. 25, 1978

[54] APPARATUS FOR CONTINUOUSLY ELECTROPLATING ON ONLY A SINGLE SURFACE OF RUNNING METAL STRIP

[75] Inventors: Masahiro Nakamura; Tetsuaki Tsuda; Hajime Amakata, all of Wakayama, Japan

[73] Assignee: Sumitomo Metal Industries, Ltd., Osaka, Japan

[21] Appl. No.: 783,024

[22] Filed: Mar. 30, 1977

[30] Foreign Application Priority Data

Mar. 31, 1976 [JP] Japan ..... 51/39731

[51] Int. Cl.[2] ..... C25D 17/00; C25D 5/02

[52] U.S. Cl. ..... 204/206; 204/15; 204/28

[58] Field of Search ..... 209/15, 28, 206

[56] References Cited

U.S. PATENT DOCUMENTS

| | | | |
|---|---|---|---|
| 1,191,386 | 7/1916 | Battle | 204/206 |
| 2,399,254 | 4/1946 | Rieger et al. | 204/206 |
| 2,490,055 | 12/1949 | Hoff | 204/206 |
| 2,509,304 | 5/1950 | Klein | 204/28 |
| 2,569,577 | 10/1951 | Reading | 204/206 |
| 3,178,305 | 4/1965 | Ward | 204/15 |
| 3,697,399 | 10/1972 | Usui | 204/15 |

FOREIGN PATENT DOCUMENTS

| | | | |
|---|---|---|---|
| 2,448,287 | 4/1976 | Fed. Rep. of Germany | 204/28 |

OTHER PUBLICATIONS

Printed Abstract vol. 632, p. 927, Mar. 21, 1950.

*Primary Examiner*—T. M. Tufariello
*Attorney, Agent, or Firm*—Watson, Cole, Grindle & Watson

[57] ABSTRACT

In a horizontal-type electroplating apparatus which includes a tank containing an electroplating bath for electroplating onto a single surface of running metal strip, the tank including anodes therein which have a width substantially equal to the width of the strip which passes through the tank, the apparatus also including an electric insulator sheet positioned in contacting relation to the upper surface of the strip which is opposite to the lower surface facing the anodes, the improvement wherein a nozzle for supplying the electroplating solution to the bath in the tank is provided at the bottom of the tank and is oriented to discharge the solution towards the lower surface of the running strip; wherein gas-jet nozzles are positioned to discharge gas towards the zones of the upper surface of the strip which are not contacted by the integral insulator sheet; and wherein an overflow device is provided along the side of the tank to control the level of the plating solution substantially equal to the level of the pass-line of the strip as it runs through the tank; each of these improvements acting to minimize the plating onto the opposite surface which is not to be plated.

6 Claims, 8 Drawing Figures

APPARATUS FOR CONTINUOUSLY ELECTROPLATING ON ONLY A SINGLE SURFACE OF RUNNING METAL STRIP

BACKGROUND OF THE INVENTION

1. Field of the Invention

The present invention relates to an improved apparatus for continuously electroplating on a single surface of running metal strip.

2. Description of the Prior Art

In a conventional apparatus for continuously electroplating on a single surface of running metal strip 2 as shown in FIGS. 1 and 2, anodes 3 each having a width substantially equal to that of the strip are supported in a tank 1 containing an electroplating bath of a plating solution by means of anode supports 12 so as to be suitably arranged in longitudinally spaced relation and facing the strip. The strip itself functions as a cathode due to its being energized by means of rolls 14. In such a bath, a portion of the current flows around the side edges of the strip to the upper surface thereof opposite to the surface of the strip to be plated, and this causes the formation of undesirable additional deposits, each having a width from 40 to 60mm, on the upper surface adjacent to the side edges. In order to eliminate such deposits, anodes have been employed each having a width substantially equal to the wiedth of the strip; in addition, electric insulator sheets (such as the two sheets 4*a* shown in FIG. 3) have been utilized which are placed in contacting relation with both side edges of the upper surface of the strip to prevent the plating solution from circulating thereover. The plating solution cannot, however, be completely prevented from circulating thereover by such measures; thus, undesirable deposits are inevitably formed in a width of about 15mm (this width exceeding the width of about 10mm which will not be tolerated by most consumers). Such deposits are, in sum, caused for the reasons which follow (realizing of course that the deposits will only form on the upper surface of the strip if the solution is in contact therewith). First of all, the level of the plating solution in the tank is conventionally far higher than the level of the pass-line of the running strip so that the surface of the strip which is not to be plated, i.e., the upper surface of the strip, is completely immersed in the solution. Further, the conventional discharge nozzle 9 for supplying the plating solution to the tank is conventionally disposed in a perpendicular fashion to the pass-line of the running strip and at the same level as that of the strip, such that the desired close protective contact between the electric insulator sheets 4*a* and the strip is interfered with by the fluid action of the incoming plating solution, and the solution circulation thereof over between the insulator sheets and the upper surface of the strip cannot thus be prevented. At the same time, it has not been thought possible to remove the plating solution which is in contact with the upper surface zones of the strip where the strip is not contacted with the electric insulator sheets.

Thus, it is a primary object of the present invention to provide an improved apparatus for continuously electroplatint on a single surface of a running metal strip and which can minimize the undesirable deposits on the surface of the strip which is not to be plated.

SUMMARY OF THE INVENTION

The present invention involves a horizontal-type electroplating apparatus having an electroplating tank containing a bath for continuously electroplating on a single surface of running metal strip wherein anodes having a width substantially equal to that of the running strip are suitably disposed in the tank in spaced relation and facing the lower surface of the strip to be plated, and wherein the strip is passed through and supported by pairs of dam rolls, and wherein an electric insulator sheet is disposed in contacting relation with the upper surface of the strip, the apparatus also including a mechanism for maintaining the plating solution at a level substantially equal to the pass-line of the strip, a mechanism for supplying and directing the plating solution from the bottom of the tank against the lower surface of the strip, and a mechanism for preventing the upper surface of the strip from being contacted by any of the plating solution.

DETAILED DESCRIPTION OF PREFERRED EMBODIMENT

Figure 1:
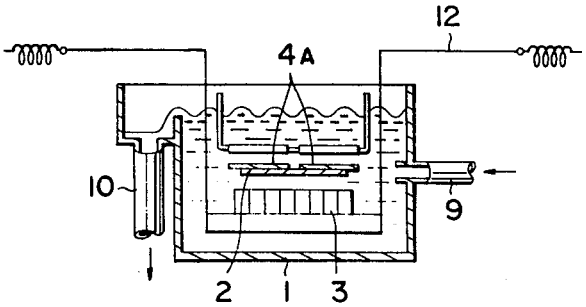
FIG. 1 PRIOR ART
FIG. 1 illustrates a sectional view of a conventional apparatus for continuously electroplating on a single surface of running metal strip taken along line I—I of FIG. 2.
Figure 2:
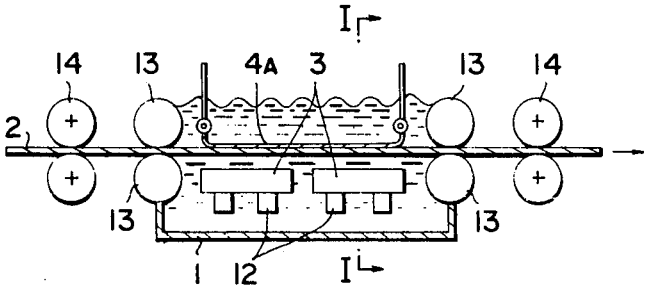
FIG. 2 PRIOR ART
FIG. 2 illustrates a side view of the conventional apparatus as shown in FIG. 1.
Figure 3:
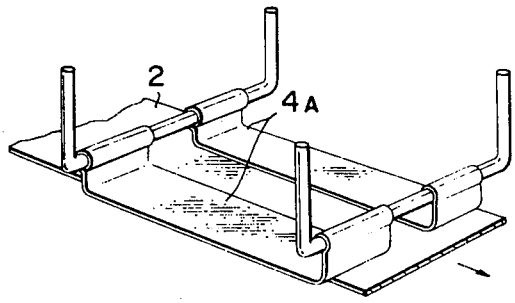
FIG. 3 PRIOR ART
FIG. 3 is a perspective view of conventional electric insulator sheets employed in the prior art.
Figure 4:
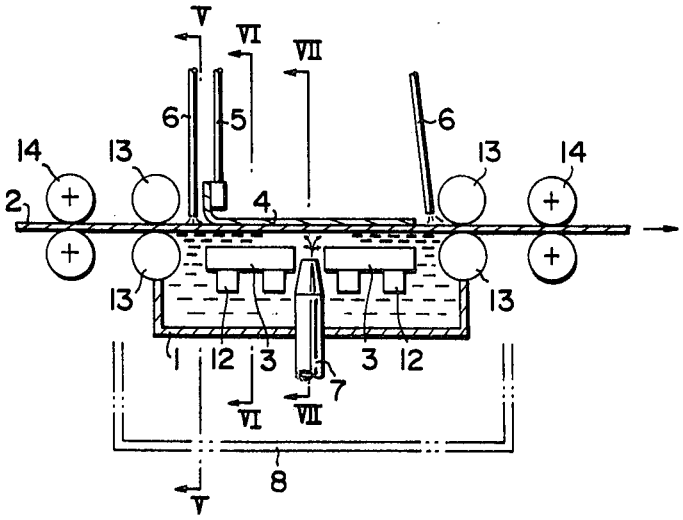
FIG. 4 shows a longitudinally sectional front view of an embodiment of the apparatus for electroplating a single surface of running strip according to the present invention.

The present invention will now be illustrated in more detail by way of reference to the attached drawings wherein like reference numerals refer to like structure. As shown in FIGS. 4 through 7, a horizontal electroplating tank 1 containing an electroplating bath is shown, and within tank 1 anodes 3 are provided, each anode having a width substantially equal to the width of the running metal strip 2 which is to /be electroplated. Each anode is arranged to be facing the surface of the strip to be plated and in suitably spaced relation thereto. An integral electric insulator sheet 4 which has a slightly wider width than that of strip 2 is dispoed on the surface of the strip opposite the surface to be plated. The longitudinal length of the sheet 4 is substantially equal to the length of the zone formed by anodes 3. The sheet 4 is supported by support members 5. Gas-jet nozzles 6 are positioned over the strip between the longitudinal sides of sheets 4 and supporting dam rolls 13 in facing relation to the upper surface of strip 2. An outlet nozzle 7 for recycling the plating solution is provided at the bottom of the tank so that the recycled solution is discharged towards and against the lower surface of the strip. The plating solution in the tank can be controlled (as discussed below) to a level substantially equal to the pass-line of running strip 2. Also, electric insulator sheet 4 may be comprised of a rubber sheet or a magnetic rubber sheet. Air or some other gas may be discharged through gas-jet nozzles 6 for removing any plating solution coming into contact with the upper surface of the strip.

According to this embodiment of the present invention, since the plating solution is controlled to a level substantially equal to the plane of the running strip, the electroplating current is generally prevented from going around either of the lower longitudinal side edges of the strip to the upper surface thereof. In addition, since the electric insulator sheet is an integral one, the portions of the upper surface of the strip which are not contacted and protected by the insulator sheet are limited to narrow zones adjacent to the both ends of the electric insulator sheet, and since the plating solution which might contact the surface of the strip which is not to be electroplated is effectively removed by the gas-jet nozzles 6, substantially no plating solution is allowed to come into contact with practically any of the upper surface of the strip. In this way, undesirable deposits on the upper surface of the strip are markedly reduced. In addition, since the inventive apparatus is designed so that the outlet direction of the recycled plating solution is towards the lower surface of the strip, the contact between the bottom surface of the insulator sheet and the upper surface of the strip is effectively maintained and, at the same time, the plating solution is caused to flow smoothly through the space between the lower surface of the strip 2 and the anodes 3 without any turbulence. Thus, equilibrium is maintained and depolarization of the electrodes is prevented. Additionally, due to the outlet nozzle 7, the plating solution can be prevented from circulating to the upper surface of the strip and therefore the amount of current which is allowed to come in contact with the upper surface of the strip can be reduced.

Figure 8:
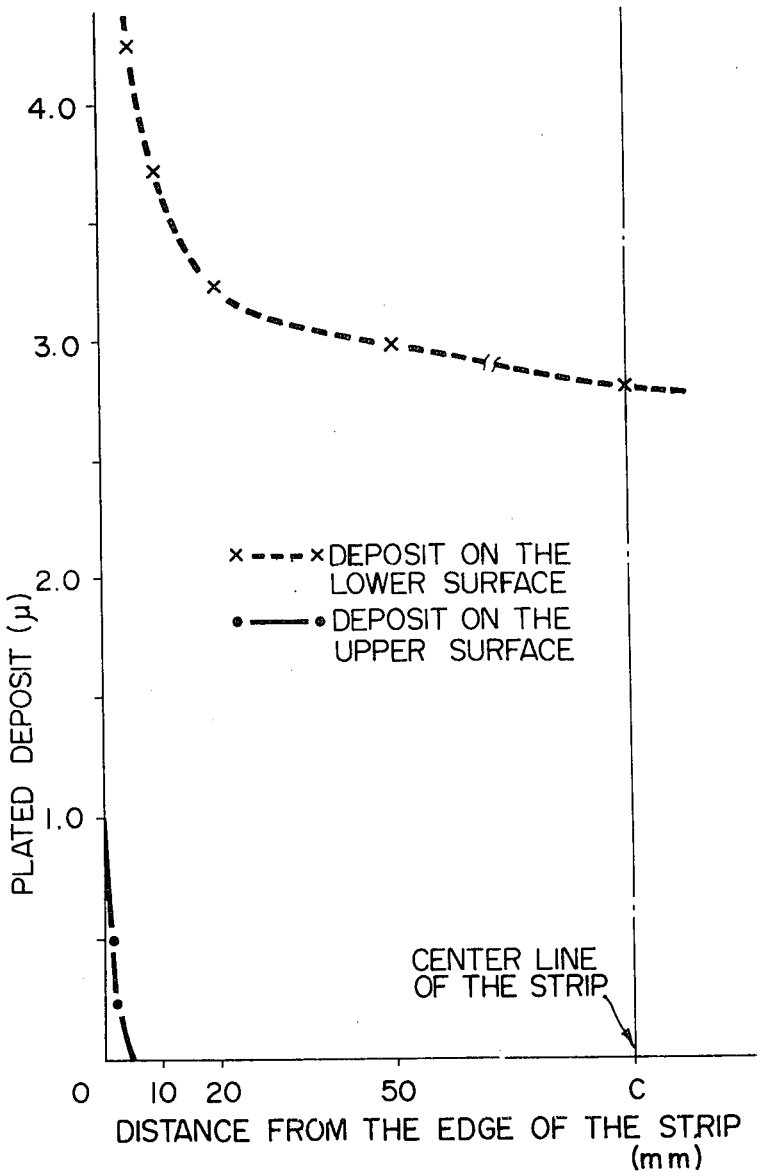
FIG. 8 illustrates a diagram showing experimental results achieved by the present invention.

FIG. 8 illustrates experimental results achieved by the apparatus according to the present invention which show clearly that the deposits on the upper surface of the strip are minimized.

Figure 5:
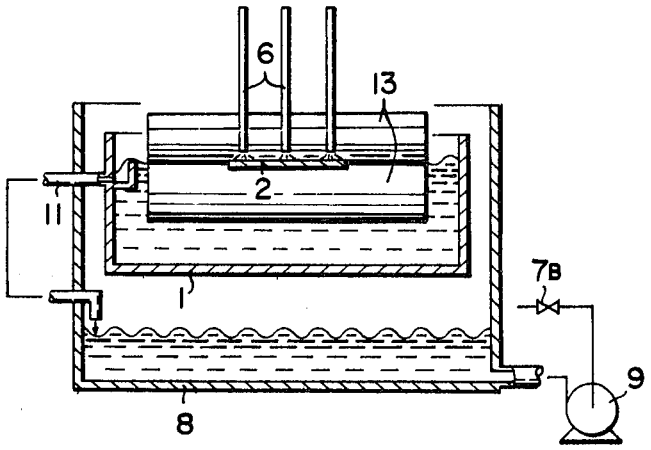
FIG. 5 is in part a sectional view taken along line V—V in FIG. 4, and includes schematic features of the electroplating system as a whole.
Figure 6:
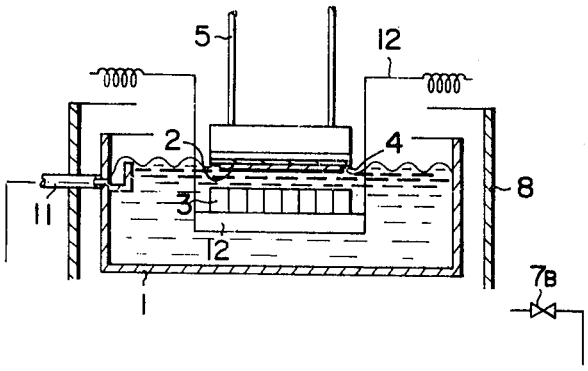
FIG. 6 is an enlarged sectional view taken along line VI—VI in FIG. 4.
Figure 7:
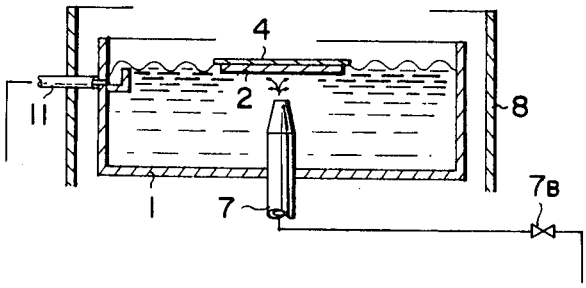
FIG. 7 is an enlarged sectional view taken along line VII—VII in FIG. 4.

FIG. 5 illustrates, partly in schematic form, the present invention as a whole. A main tank 8 is installed below electroplating bath tank 1. An overflow system, including a weir and piping 11, is attached to a side of bath 1 at the level of the pass-line of the running strip, whereby the plating solution can be maintained at a level substantially equal to that of the pass-line of the strip. Namely, the overflow system is provided on bath tank 1 at a position where a pair of dam rolls 13, which support the running strip, are in nip contact.

The overflow piping 11 is connected to main tank 8 in operation. The plating solution contained in main tank 8 is recirculated and discharged through outlet nozzle 7 via a pump means 9 and a check valve 7B, which valve is installed for purposes of safety in operation. The plating solution discharged from outlet nozzle 7 then replenishes the electroplating bath, and any excess amount of the solution is discharged through the overflow system noted above. Thus, the solution in bath tank 1 is maintained at a constant level, i.e., at the level of the pass-line of the running strip 2.

As discussed hereinbefore, the present invention can reduce significantly the amount of undesirable plating on the surface of the strip opposite to the surface to be plated so that the resultant product is more in conformity with the needs of the ultimate consumers.

Obviously, many modifications and variations of the present invention are made possible in the light of the above teachings. It is therefore to be understood that within the scope of the appended claims the invention may be practiced otherwise than as specifically described.

What is claimed is:

1. In a horizontal-type electroplating apparatus having a tank for containing electroplating bath for continuously electroplating a single surface of metal strip which runs therethrough, said apparatus including a multiplicity of anodes positioned within said tank along the direction of metal strip movement therethrough which have a width substantially equal to the width of the strip, said anodes being in spaced relation to and facing the lower surface of said strip, a pair of opposed dam rolls attached to opposite sides of said tank and in supporting relation to the strip so as to determine the direction of metal strip movement through said tank, and an electrically insulating sheet positioned in close proximity with the upper surface of said strip, the improvement wherein means are provided for maintaining the electroplating solution in said tank at a level substantially equal to the pass-line of said running strip in said tank; wherein means are provided at the bottom of the tank for supplying the plating solution thereto so as to be discharged against the lower surface of said strip; and wherein means are provided for preventing the plating solution from contacting the upper surface of said strip; said means for supplying the electroplating solution comprising a nozzle, and wherein said nozzle is positioned to extend through a floor of said tank and into said tank to a point approximately coincident with the positioning therein of said anodes, and between two adjacent anodes, and so as to discharge electroplating solution towards said strip passing beneath said insulator sheet at a point about midway of the width of said insulator sheet.

2. The improvement according to claim 1 wherein said means for maintaining the level of the electroplating solution comprises an overflow system connected to said tank at a level substantially the same as the level of said pass-line of said strip in said tank.

3. The improvement according to claim 2 wherein said overflow system includes an overflow weir and an overflow piping.

4. The improvement according to claim 3 wherein said apparatus includes a main tank positioned below said electroplating tank, said main tank being connected to said electroplating tank by said overflow piping, and including a pump and connecting piping for recirculating the electroplating solution from said main tank to said means provided at the bottom of said tank for discharge against the lower surface of said strip.

5. The improvement according to claim 1 wherein said electrically insulating sheet is integral and is positioned in contacting relation to the upper surface of said strip, and wherein said means for preventing the plating solution from contacting the upper surface of said strip comprises gas-jet nozzles installed above the running strip to discharge against the upper surface thereof between both longitudinal sides of said insulator sheet and said supporting dam roll pairs.

6. The improvement according to claim 1 wherein said insulator sheet has a width slightly wider than the width of said strip and a length substantially equal to the length of the zone formed by said anodes.

* * * * *